US006084608A

United States Patent [19]

Harvey et al.

[11] Patent Number: 6,084,608

[45] Date of Patent: Jul. 4, 2000

[54] PARTICLE-REINFORCED WIPER FOR INK JET PRINT HEAD

[75] Inventors: James A. Harvey; John H. Dion, both of Corvallis, Oreg.; Thomas J. Purwins, Vancouver, Wash.

[73] Assignee: Hewlett-Packard Company, Palo Alto, Calif.

[21] Appl. No.: 08/710,597

[22] Filed: Sep. 19, 1996

[51] Int. Cl.[7] ..... B41J 2/165

[52] U.S. Cl. ..... 347/33

[58] Field of Search ..... 347/33, 22–23; 15/256.5, 250.42, 256.2, 250.06; 399/350; 156/386–388

[56] References Cited

U.S. PATENT DOCUMENTS

| | | | |
|---|---|---|---|
| 4,427,452 | 1/1984 | Jeffs . | |
| 4,546,017 | 10/1985 | Flackett et al. . | |
| 5,153,657 | 10/1992 | Yu et al. | 355/299 |
| 5,171,773 | 12/1992 | Chaffee et al. . | |
| 5,232,982 | 8/1993 | Lucas . | |
| 5,484,848 | 1/1996 | Jadamus et al. . | |
| 5,489,927 | 2/1996 | Harmon | 347/33 |
| 5,610,641 | 3/1997 | Ikado | 347/33 |
| 5,610,699 | 3/1997 | Yu et al. | 399/350 |

FOREIGN PATENT DOCUMENTS

| | | | |
|---|---|---|---|
| 0475424 | 3/1992 | European Pat. Off. | B41J 2/165 |

OTHER PUBLICATIONS

Webber et al. Webster's II New Riverside University Dictionary (p. 922), 1994.

"Rubber Technology," by Maurice Morton, Chapter 3 — Fillers. Van Nostrand Reinhold, New York. 1988.

Commercial Brochure. "A Guide to Dow Corning Silane Coupling Agents," Dow Corning Corporation. 1990.

*Primary Examiner*—N. Le
*Assistant Examiner*—Thien Tran

[57] ABSTRACT

An ink jet print head wiping apparatus having a wiper blade comprising a flexible elastomeric matrix containing particles of a harder material than the matrix, such that the particles resist wear to prolong the useful life of the wiper, the particle material may be a non abrasive but hard polymer such as polyethylene, which may be bonded to the matrix with a coupling agent such as silane.

17 Claims, 1 Drawing Sheet

PARTICLE-REINFORCED WIPER FOR INK JET PRINT HEAD

FIELD OF THE INVENTION

This invention relates to flexible wipers, and more particularly to wipers for removing liquid or debris from print heads of ink jet printers.

BACKGROUND AND SUMMARY OF THE INVENTION

The orifice plate of a print head in an ink jet printer tends to collect debris such as paper dust during the printing process. The debris adheres to the orifice plate due to the occasional accumulation of ink droplets or an electrostatic charge. If left dirty, the accretion of debris and ink may impair printing quality by blocking or deflecting the passage of ink droplets during printing.

Some existing printers remove such debris with wipers that function as squeegees. A typical wiper has a cantilevered elastomeric blade extending perpendicularly to the orifice plate. As the plate slides past the blade, the blade is deflected to contact the plate with a force based on the modulus of the wiper material and the amount of the deflection. Because orifice plates on ink jet printers may have contours for functional reasons, the blade must be sufficiently flexible to variably conform to the surface it wipes, including reaching into slight recesses on the plate. Thus, an elastomeric material with good flexibility is needed.

Because a pen wiper should last the lifetime of the printer to avoid unwanted repairs, premature wear is a significant concern, particularly with the softer elastomers that are optimized for flexibility. Abrasion of the wiper over time is particularly a concern because a sharp, smooth wiper edge wipes best, resulting in a relatively high pressure on the small region of contact. Thus, a sharp edge may dull prematurely, resulting in impaired wiping.

To avoid the tradeoff between flexibility and wear resistance in other applications, elastomers have been reinforced by embedding harder particles in a rubber matrix. Typical filler particles are clay, calcium carbonate, carbon black, milled glass, glass fibers, and silica. The filler particles interact with the rubber matrix through mechanical attachments. In certain applications, the properties of elastomer have been enhanced by the use of silane coupling agents such as γ-aminopropyltriethoxysilane and vinyltriethoxysilane, whereby a chamical bond was formed between the filler particles and the rubber matrix. Silica and glass particles have proven particularly effective, as they have appropriate surface chemistries available for bonding to the silane coupling agent.

However, bonded fillers are believed not to have been previously applied to printer applications, as the materials suitable for bonding may be prone to excessively wear the print head surface being wiped due to their abrasive nature. Furthermore, such particles increase friction in a circumstance in which reduced friction is preferred.

Therefore, there remains a need for an ink jet print head wiping apparatus having a wiper blade comprising a flexible elastomeric matrix containing particles of a harder material than the matrix, such that the particles resist wear to prolong the useful life of the wiper, the particle material may be a non abrasive but hard polymer such as polyethylene, which may be bonded to the matrix with a coupling agent such as silane.

DETAILED DESCRIPTION OF A PREFERRED EMBODIMENT

Figure 1:
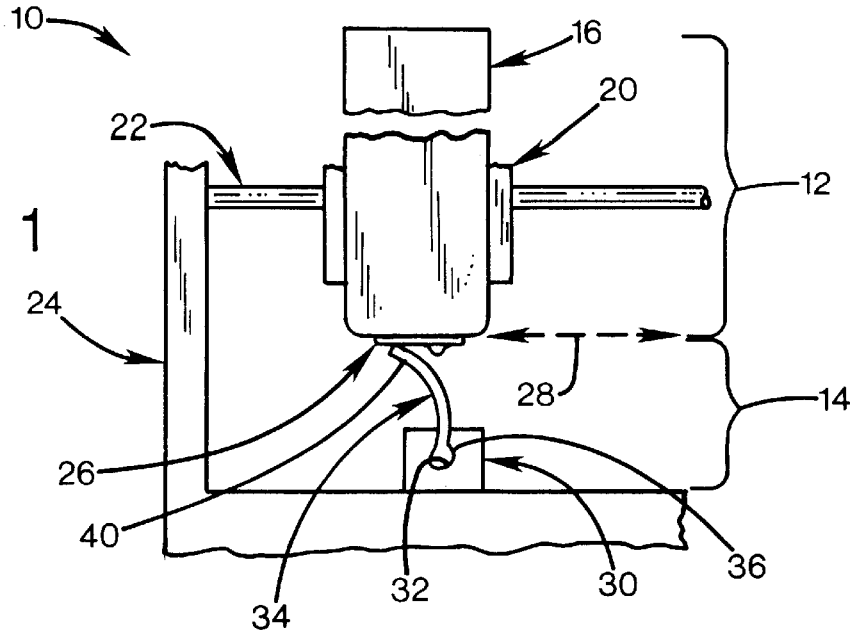
FIG. 1 is a simplified side view of an ink jet printer according to a preferred embodiment of the invention.

FIG. 1 shows an ink jet printer 10 including a printing mechanism 12 and a wiping mechanism 14. The printing mechanism 12 includes an ink jet pen 16 mounted to a pen carriage 20 that is mounted to reciprocate on a guide bar 22 that is mounted to a printer frame 24. The pen 16 includes an orifice plate 26 that defines a multitude of orifices through which ink droplets are sequentially expelled to generate an image on a sheet of printer media (not shown) as the pen reciprocates along the bar 22. The motion of orifice plate 26 defines a linear pen path 28.

The wiper mechanism 14 includes a wiper support member 30 mounted to the frame 24 at a position adjacent to and beneath the pen path 28. The wiper support member defines a elongated channel 32 extending perpendicular to the plane of the figure and to the pen path, and a wiper blade 34 is connected to the wiper support member 30. The blade 34 includes a wide bead or body portion 36 that is captured in the channel 32, and a planar extending portion 40 (shown deflected by the presence of the pen 16.)

Figure 2:
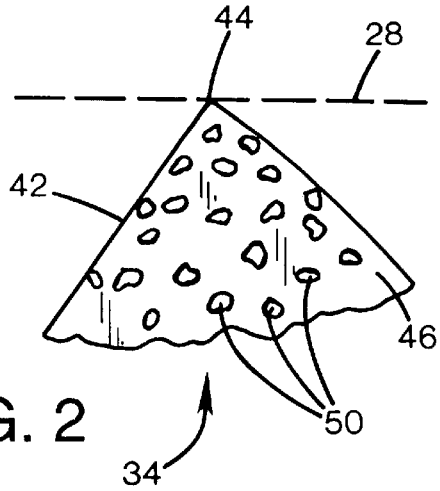
FIG. 2 is an enlarged sectional view of the wiper of FIG. 1 in a new condition.

As shown in FIG. 2, the free end of the wiper blade 34 terminates at a flat edge face 42 perpendicular to the major faces of the extending portion 40, and meeting the major faces at a right angle along respective blade edges 44. The blade is positioned to extend sufficiently far across the pen path 28 when undeflected so that it presents an edge against the orifice plate with the edge face 42 at a 45 degree angle to the pen path 28. The wiper may function as the pen passes in either direction, with the wiper presenting a different edge 44 against the orifice plate, depending on the relative direction of travel of the pen. In the preferred embodiment, the pen moves relative to the wiper. In alternative embodiments, the wiper may be movable relative to a stationary pen, or may be movable on an axis offset by an angle from the path of pen motion.

The wiper blade is primarily formed of two different materials: an elastomeric matrix 46, and a multitude of filler or reinforcing particles 50 distributed throughout the matrix. To provide integrity, the particles are adhered to the matrix. The particles 50 are evenly distributed throughout the matrix, and are particularly required to be present at the blade edges 44, as they provide wear resistance against the abrasion caused by repeated wiping of the orifice plate. In an alternative embodiment, the particles may be concentrated at the edges, and may be absent elsewhere from the blade, if desired.

Figure 3:
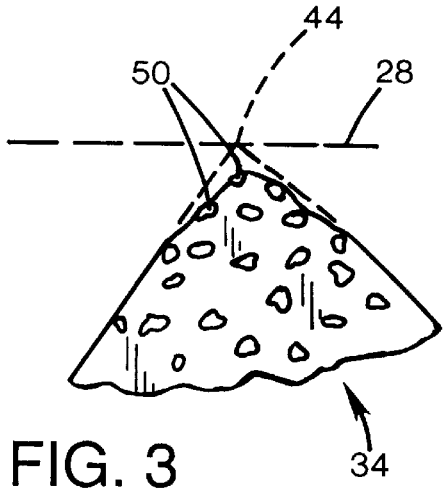
FIG. 3 is an enlarged sectional view of the wiper of FIG. 1 in a used condition.

As shown in FIG. 3, which reflects the appearance of the particle-reinforced wiper blade after significant use, the matrix has been abraded at the edge to reveal portions of particles 50. Because the particles are harder and more wear resistant than the matrix material, they "hold the line" against further wear, so that wear progresses much more slowly once particles are exposed. Eventually, an exposed particle may wear away, and allow a small additional amount of the matrix to abrade until another particle is exposed, but this process is much slower than the rate of wear of even a relatively stiff elastomer, and normally occurs after the intended life span of the printer.

In the preferred embodiment, the matrix is EPDM (Ethylene propylene dimer mmonomer,) a thermoset elastomer with a Shore A durometer hardness of 60, although hardness levels in the range of 20 to 90 may be suitable. Alternative matrix materials may include polyisoprenes, polyurethane thermoplastic elastomers, silicone rubbers, fluoroelastomers, fluorosilicon elastomers, EPDM thermoplastic elastomers, natural rubbers, brominated and chlorinated rubbers, and other known elastomeric compounds.

To avoid generating unwanted wear or damage to the metal orifice plate by the reinforcing particles, the particle material is preferably selected to be a low friction rigid polymer such as polyethylene. Suitable alternatives include polypropylene, polytetrafluoroethylene, and other partially and fully fluorinated thermoplastics such as FEP (fluorinated ethylene propylene) and ECTFE (ethylene/chlorotrifluoroethylene.)

However, such low friction materials are generally not well suited for bonding to elastomers, as they lack the surface chemistry to generate strong adhesion. When the matrix wears away and exposes poorly adhered particles, they tend to be extracted from the matrix before they have served their purpose to resist wear. This also is a source of contaminant particles that may impair ink jet performance.

Figure 4:
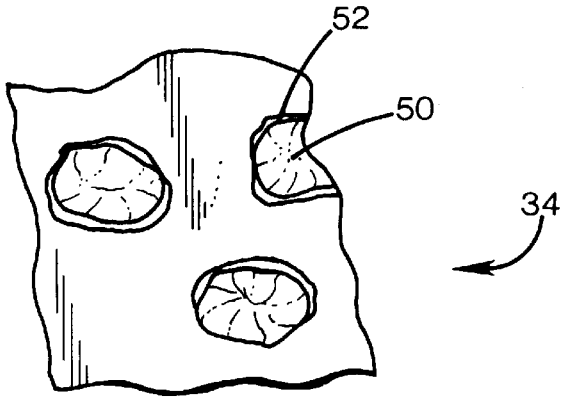
FIG. 4 is a further enlarged sectional view of the wiper of FIG. 1.

Therefore, it is necessary to create a chemical bond between the particles and the matrix. A chemical attraction may also be formed, and such "attraction" shall be defined as included within the term "bond" as used herein. As shown in FIG. 4, the particles 50 are each surrounded with a coupling agent layer 52. The coupling agent may be contained within the matrix material, or may be precoated onto the particles prior to mixing with the elastomer, as will be discussed below with regard to the preferred method of manufacturing. In the preferred embodiment, the coupling agent can be either γ-aminopropyltriethoxysilane, available from OSI Specialities, Inc. of Tarrytown, N.Y., or vinyltriethoxysilane available from OSI and Dow Corning Corp. of Midland, Mich. Suitable chemical coupling agent alternatives include the chemical families of zirconates, titanates, and organic azo and azide compounds.

The coupling agent serves to create a composite instead of a blend of materials, by reacting chemically with each of the composite components. The coupling agent must include a first functionality capability of reacting onto the matrix resin. This is provided either by the amino ($NH_2$) functionality of the γ-aminopropyltriethoxysilane coupling agent, or by the vinyl ($CH_2$=CH—) functionality of the vinyltriethoxysilane coupling agent. These chemical moieties are capable of attaching themselves to the elastomeric polumer backbone, either by chemical reactions or by chemical attractions. A second functionality of the silane coupling agent is the silicotriester, $Si(OR)_3$, where the R represents a carbon-containing alkyl group such as methyl ($CH_3$) or ethyl ($CH_3CH_2$.) Because the preferred polyethylene particles are chemically similar to the EPDM elastomer, the vinyl functional functionality can react either with the PE or with the EPDM, and the silicotriol can also be chemically attracted to both PE and EPDM.

The silicoester has preferably been hydrolyzed to a Si—OH bond that is capable of chemically attaching itself to the particles either through chemical reaction, or by other bonding mechanisms such as hydrogen bonding. In the preferred embodiment, this is achieved by chemical attraction with the γ-aminopropyltriethoxysilane coupling agent and chemical reaction with the vinyltriethoxysilane coupling agent.

The resulting composite has different performance than would a simple blend, in that it resists particle dislodgement, which in turn causes the wiper to hold its initial shape longer, thus providing increased effective lifetime of the wiper with the silane chemically coupled particles, as compared to the effects that would be expected by the blend itself.

In the preferred embodiment, the polyethylene particles are typically 1–2 μm in diameter, although they may suitably range from 0.5 to 5.0 μm in alternative embodiments. These values assume an ink jet orifice diameter of 20 μm; particles must be a minor fraction of orifice diameter so that they do not clog orifices if dislodged. For smaller or larger orifices, sizes should be adjusted proportionally.

To achieve sufficient reinforcement, the particles should comprise at least 2% of the composite by weight, and should comprise no more than about 50% to avoid compromising flexibility unacceptably. Preferably, the particles comprise 20% of the composite. The coupling agent comprises about 1.0% of the particles by weight, and may range between 0.5 and 1.5%. If the coupling agent is mixed into the matrix material prior to particle mixing a ratio of 1 part silane to 500 parts matrix material is preferred.

The selected coupling agent may be used to retain alternative or additional filler materials such as carbon black or silica In the preferred embodiment, the wiper blade material is produced by several steps. First, a supply of silane is hydrolyzed by mixing with water, or, in the case of vinyl based compounds, with glacial acetic acid. Then, the hydrolyzed siliane is mixed with the filler particles in the proportions discussed above to react with the particle material. The particles are then dried at 90° C. while tumbling a batch under a vacuum to leave a coating of dried hydrolyzed silane. For particles other than polyethylene, such as Teflon and carbon black, higher temperatures of about 120° C. may be used. The coated particles are then mixed with liquid matrix material to evenly disperse them throughout the mix, and to permit the matrix to react with the coating prior to or during its curing to a sold form. The mixture may be molded, extruded, or formed by any conventional means into the desired blade shape. In an alternative process, the coupling agent may be mixed into the liquid matrix material prior to adding the filler particles.

While the above is discussed in terms of preferred and alternative embodiments, the invention is not intended to be so limited.

What is claimed is:

1. An ink jet print head wiping apparatus comprising:

a frame;

an ink jet cartridge support member connected to the frame;

a wiper support member connected to the frame; and a wiper blade connected to the wiper support member, the wiper blade comprising a flexible elastomeric matrix containing a plurality of solid particles of a polymeric particle material different from the elastomeric matrix, the particles being chemically bonded to the matrix, the particle material being harder than the elastomeric matrix, such that the particles resist wear.

2. The apparatus of claim 1 wherein the particles are distributed throughout the matrix.

3. The apparatus of claim 1 wherein the particles are formed of a polymeric material.

4. The apparatus of claim 1 wherein the wherein the particles are formed of polyethylene.

5. The apparatus of claim 1 wherein the particle material is selected from a group consisting of polymers and carbon black.

6. The apparatus of claim 1 including a coupling agent forming a chemical bond between the matrix and the particles.

7. The apparatus of claim 6 wherein the coupling agent is an organosilicon compound selected from the chemical family of silane coupling agents.

8. A flexible wiper for wiping fluid droplets from a wetted surface comprising:

a wiper support frame;

a body connected to the frame and a flexible wiper blade connected to the body and extending away from the frame; and the wiper blade comprising a matrix of an elastomeric material and a multitude of solid particles of a different polymeric particle material embedded within the matrix, and chemically bonded to the matrix.

9. The apparatus of claim 8 wherein the particles are distributed throughout the matrix.

10. The apparatus of claim 8 wherein the particle material is harder than the elastomeric material.

11. The wiper of claim 8 wherein the particles are formed of a polymeric material.

12. The wiper of claim 8 wherein the wherein the particles are formed of polyethylene.

13. The apparatus of claim 8 wherein the wherein the particle material is selected from a group consisting of polymers and carbon black.

14. The wiper of claim 8 including a coupling agent forming a chemical bond between the matrix and the particles.

15. The wiper of claim 14 wherein the coupling agent is an organosilicon compound selected from the chemical family of silane coupling agents.

16. A flexible wiper for wiping fluid droplets from a wetted surface comprising:

a wiper support frame;

a body connected to the frame and a flexible wiper blade connected to the body and extending away from the frame; and the wiper blade comprising a matrix of an elastomeric material and a multitude of polymeric particles embedded within the matrix, and chemically bonded to the matrix.

17. The wiper of claim 16 including a coupling agent forming a chemical bond between the matrix and the particles.

* * * * *

UNITED STATES PATENT AND TRADEMARK OFFICE

CERTIFICATE OF CORRECTION

PATENT NO. : 6,084,608
DATED : July 4, 2000
INVENTOR(S) : Harvey et al.

It is certified that error appears in the above-identified patent and that said Letters Patent is hereby corrected as shown below:

Column 5,
Line 24, delete “apparatus” and insert therefor -- wiper --.
Line 26, delete “apparatus” and insert therefor -- wiper --.

Column 6,
Line 5, delete “apparatus” and insert therefor -- wiper --.

Signed and Sealed this

Fifth Day of November, 2002

*Attest:*

*Attesting Officer*

JAMES E. ROGAN
*Director of the United States Patent and Trademark Office*